US007117777B1

(12) United States Patent
Wilkes

(10) Patent No.: US 7,117,777 B1
(45) Date of Patent: Oct. 10, 2006

(54) FLYING PUNCH FOR WEBS

(75) Inventor: Kenneth R. Wilkes, Asheville, NC (US)

(73) Assignee: River Solutions, Inc., Asheville, NC (US)

( * ) Notice: Subject to any disclaimer, the term of this patent is extended or adjusted under 35 U.S.C. 154(b) by 92 days.

(21) Appl. No.: 10/772,047

(22) Filed: Feb. 4, 2004

(51) Int. Cl.
*B26D 1/56* (2006.01)

(52) U.S. Cl. ..... 83/320; 83/323; 83/324; 83/356.3

(58) Field of Classification Search ..... 83/356.3, 83/321, 322, 323, 318, 319, 320, 324
See application file for complete search history.

(56) References Cited

U.S. PATENT DOCUMENTS

| | | | | | |
|---|---|---|---|---|---|
| 1,333,704 | A * | 3/1920 | Buschmeyer | ..... | 83/328 |
| 2,564,354 | A * | 8/1951 | Connor | ..... | 83/103 |
| 2,855,998 | A * | 10/1958 | Einhiple | ..... | 83/327 |
| 3,861,260 | A * | 1/1975 | Kesten et al. | ..... | 83/328 |
| 4,083,273 | A * | 4/1978 | Hillman et al. | ..... | 83/867 |
| 4,485,709 | A * | 12/1984 | Huber et al. | ..... | 83/324 |
| 4,485,713 | A * | 12/1984 | Dotta | ..... | 83/543 |
| 4,542,670 | A * | 9/1985 | Borzym | ..... | 83/295 |
| 4,919,351 | A * | 4/1990 | McNeil | ..... | 242/521 |
| 4,964,325 | A * | 10/1990 | Hartmann et al. | ..... | 83/321 |
| 5,355,753 | A * | 10/1994 | Hausler et al. | ..... | 83/37 |
| 5,932,985 | A * | 8/1999 | Hayashi | ..... | 318/560 |
| 6,024,683 | A * | 2/2000 | Wilkes | ..... | 493/196 |
| 6,339,947 | B1 * | 1/2002 | Bodnar | ..... | 72/190 |

* cited by examiner

*Primary Examiner*—Charles Goodman
(74) *Attorney, Agent, or Firm*—Blakely Sokoloff Taylor & Zafman LLP

(57) ABSTRACT

A punching station for a web includes a web transport system that operates to advance the web in a first direction at a first rate. A clamp intermittently grips a portion of the web to advance the portion in the first direction at a second rate. A punch is coupled to the clamp such that the punch moves in the first direction together with the clamp. A punch block cooperates with the punch. The punch block is coupled to the clamp such that the punch block moves in the first direction in unison with the clamp. A punch actuator causes the punch to penetrate the web and then to be withdrawn from the web while the web is gripped by the clamp.

19 Claims, 4 Drawing Sheets

FLYING PUNCH FOR WEBS

BACKGROUND OF THE INVENTION

A variety of products may be made from webs of sheet materials. Webs are very long lengths of sheet material that are generally supplied in roll form. Paper, plastic sheets, fabric, and sheet metal are examples of materials that may be provided in web form. Processing material in web form may lend itself to high speed production of large numbers of items.

Web processes may take advantage of the ability to rapidly feed the web material to successive processing stations in a substantially continuous fashion. The processing stations may perform any of a variety of operations on the web, such as punching, cutting, sealing, or imprinting. Generally each processing station will perform a single type of operation. A series of processing stations may be arranged such that the raw web material is supplied to the first of the series of stations. The processed result of each of the series of stations may be supplied to the next station until a finished article emerges from the last of the series of stations.

Bags and pouches are examples of items that can be made using a web process. One process for making pouches uses two webs of raw sheet material. The two materials may be identical or dissimilar. One processing step, possibly the first step, is to laminate the two sheets along a seam line to create a pouch. The final processing step may be a cutting operation to separate the web of pouches into individual items.

It will be appreciated that each processing station must process the web at the same average rate. Accumulators may be used to absorb momentary differences in the speed at which the web is advancing through a processing station. But ultimately the time available for each processing station to process the same number of items is the same.

Returning to the example of the laminated pouch, the process for laminating the two webs may require that a seaming iron press the two webs together for a period of time, such as one second. This may require stopping the web in the processing station for a period of time that it takes to laminate the seam. As a result, the laminating station might produce one item per second. To increase the production rate of a laminating station, the seaming iron may be arranged so that more than one item is formed along the length of the web in a single laminating operation. For example, if the seaming iron produces twenty pouches along the length of the web, the laminating station might produce twenty items per second.

It will be appreciated that more than one item may be produced across the width of the web. For example, the seaming iron might produce four pouches across the width of the web increasing the production rate to 80 items per second. Since this merely requires duplication of the processing mechanism across the width, only the processing of one item across the width will be discussed for clarity. However, it is to be understood that all the web operations that are discussed may be extended to any number of items across the width of the web.

A web process that includes a processing station that requires stopping the web for a significant length of time and which produces multiple items along the length of the web to increase the production rate may create a dilemma for other processing stations in the web process. It may be desirable to minimize the starting and stopping of the web. Thus it may be desirable for each processing station that has to stop the web to stop the web at the same time and for the same duration.

Again returning to the example of the laminated pouch, the pouch may include one or more features that require punching operations, such as a hanging hole, a tear notch, or rounded corners. If the web moves against the punch while the punch is penetrating the web, the web may tear or crumple. Therefore, a punching operation that punches the same number of items along the length of the web as are produced by the laminating operation might be desirable. However, the tooling for punching may be more difficult or costly to replicate along the length of the web than the seaming iron tooling.

It would be desirable to have a punching station for a web and that does not require the use of multiple punch tooling along the length of the web.

SUMMARY OF THE INVENTION

A punching station for a web includes a web transport system that operates to advance the web in a first direction at a first rate. A clamp intermittently grips a portion of the web to advance the portion in the first direction at a second rate. A punch is coupled to the clamp such that the punch moves in the first direction together with the clamp. A punch block cooperates with the punch. The punch block is coupled to the clamp such that the punch block moves in the first direction in unison with the clamp. A punch actuator causes the punch to penetrate the web and then to be withdrawn from the web while the web is gripped by the clamp.

DETAILED DESCRIPTION OF THE INVENTION

The present invention provides a punching station for a web that is compatible with other processing stations that produce multiple items along the length of the web without requiring the use of multiple punch tooling along the length of the web by providing a punching station that does not require stopping the web for the punching operation. The last operation in a web process is often a cutting operation separate the completed items into individual units. It may be desirable that only one item be cut from the length of the web so that all cut items may be readily collected.

It may be desirable that the cutting operation be performed on a moving web such the cutting operation disclosed in U.S. Pat. No. 6,024,683. Thus the web process may begin with one or more operation which require stopping the web and then conclude with one or more operations, including punching using an embodiment of the invention, that are performed without stopping the web.

Figure 1:
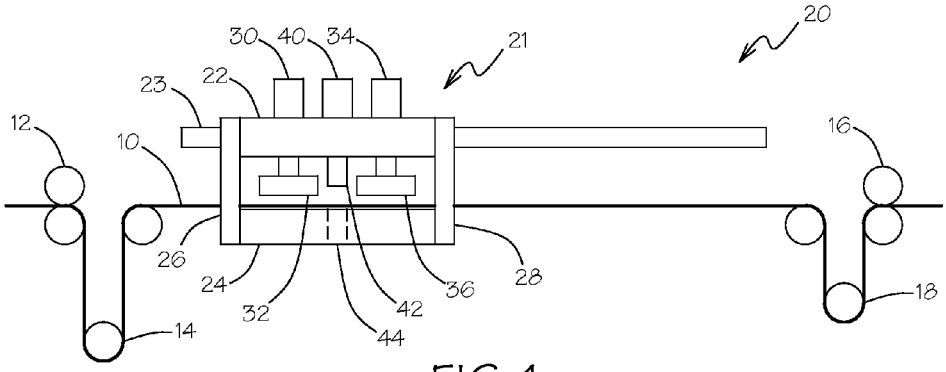
FIG. 1 is a schematic view of a punching station for a web that embodies the invention.

FIG. 1 shows a punching station 20 for a web 10 that embodies the invention. A pair of rollers 12 may feed the web 10 to the punching station 20. Another pair of rollers 16 may pull the web 10 from the punching station 20 and may feed the web to other processing stations. The punching station 20 processes the portion of the web 10 that is between the two pairs of rollers 12, 16.

It will be appreciated that both pairs of rollers 12, 16 have to feed the web 10 at the same average speed. Dancers 14, 18 may be provided before or after the punching station 20 to maintain loops of the web that accommodate instantaneous differences in the speed of the portion of the web 10 that is between the two pairs of rollers 12, 16. Dancers 14, 18 may be provided both before and after the punching station 20 as shown in the figures.

The punching station 20 shown in FIG. 1 includes a punch head 21 that moves with a reciprocating motion. The punch head may be motivated by any of a variety of motive devices such as hydraulic cylinders, air cylinders, screw drives, or linear actuators. The punch head 21 may be supported by one or more members 23. The supporting member 23 or members may be of any of a variety of forms such as rails, bearing carriages, or swing links.

The punch head 21 may include a first toolbar 22 that is disposed to a first side of the web 10 and a second toolbar 24 that is disposed to a second side of the web opposite the first side. The first and second toolbars 22, 24 may be coupled by support members 26, 28 such that the web 10 passes between the first and second toolbars.

The punch head 21 includes one or more clamps 32, 36 that may be supported by the first toolbar 22. The clamps 32, 36 may be coupled to one or more clamp actuators 30, 34 such that the clamps can grip a portion of the web 10 and cause the gripped portion of the web to move at the same speed as the punch head 21. The clamp actuators 30, 34 may be any of a variety of actuating devices such as hydraulic cylinders, air cylinders, or solenoids. The clamps 32, 36 may be coupled to the punch head 21 in such a way that the clamps are actuated by the motion of the punch head such as by a cam mechanism or a linkage mechanism.

The clamps 32, 36 are actuated to grip the web 10 as the punch head 21 is moving in the same direction as the web and at substantially the same speed as the web. The dancers 14, 18 may operate to accommodate differences between the speed of the web 10 and the speed of the punch head 21. The portion of the web 10 that is gripped by the clamps 32, 36 does not move with respect to the punch head 21.

The punch head 21 includes one or more punches 42 and corresponding punch blocks 44. The punch block 44 may be an opening that receives the punch 42 or a surface that the punch operates against. The punch 42 may be coupled to a punch actuator 40. The punch 42 and punch block 44 are arranged on opposite sides of the web 10 such that the punch actuator 40 will drive the punch and punch block together to punch the portion of the web that is gripped by the clamps 32, 36. The punch actuator 40 may be any of a variety of actuating devices such as hydraulic cylinders, air cylinders, or solenoids. The punch actuator 40 may be coupled to the punch head 21 in such a way that the punch is actuated by the motion of the punch head such as by a cam mechanism or a linkage mechanism. While the gripped portion of the web 10 is moving at substantially the same speed as the remainder of the web, that portion is not moving within the punch head 21 thus allowing the web to be punched without the need to stop the web.

FIGS. 1 through 6 illustrate an exemplary punching cycle. In FIG. 1 the punch head 21 is shown near the position where the punch head has begun to move in the same direction as the web 10. At this point the clamps 32, 36 are not actuated and the web 10 is moving independently of the punch head 21. The punch head 21 may be accelerating toward substantially the same speed as the web.

Figure 2:
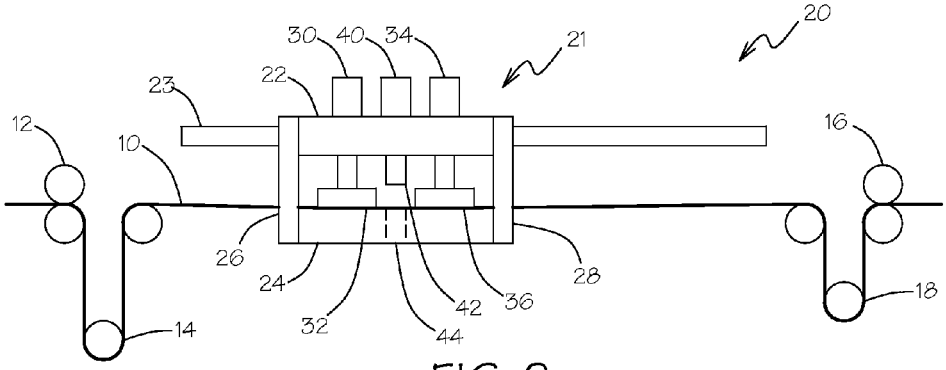
FIGS. 2 through 6 show the punching station of FIG. 1 at different point of the operating cycle.

In FIG. 2 the clamps 32, 36 are actuated to hold a portion of the web 10 stationary with respect to the punch head 21. The punch head 21 is moving at substantially the same speed as the web 10.

Figure 3:
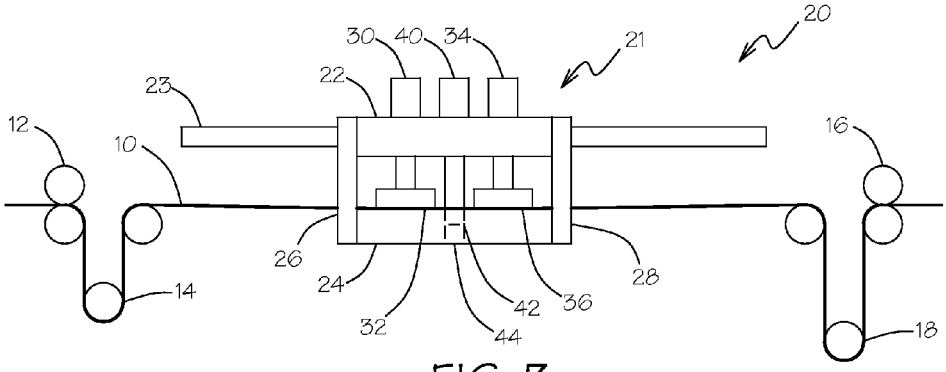

In FIG. 3 the punch 42 is actuated to form a hole in the web 10. It will be appreciated that the clamping of the web 10 within the punch head 21 permits punching of the web as though it were stopped while keeping the web in motion. In FIG. 3 it may be seen that the left dancer 14 has risen and the right dancer 18 has descended to accommodate a punch head 21 that is moving slightly faster than the web 10. The motion of the dancers 14, 18 would be opposite if the punch head 21 were moving slightly slower than the web 10.

Figure 4:
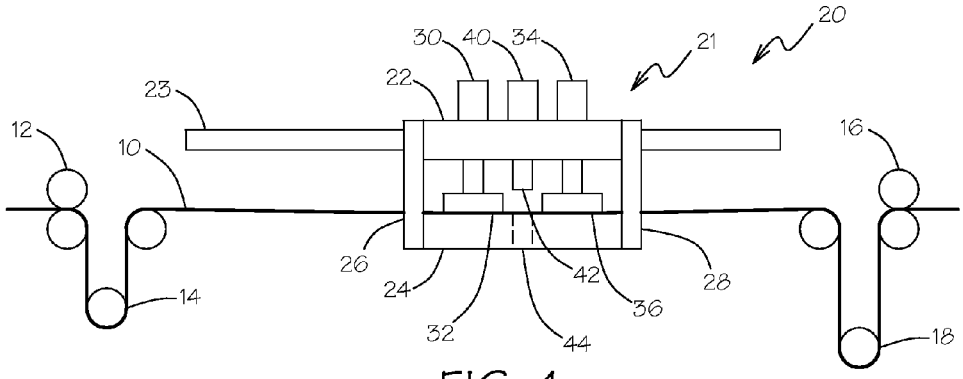

In FIG. 4 the punch actuator 40 has withdrawn the punch 42 from the web 10. The clamps 32, 36 remain actuated to hold the web 10 stationary with respect to the punch head 21 and the punch 42 as the punch is withdrawn.

Figure 5:
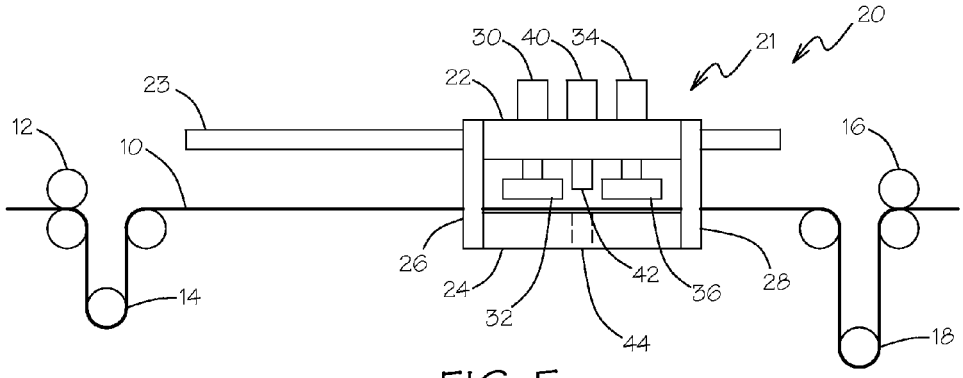

In FIG. 5 the clamps 32, 36 are released and the web 10 is again moving independently of the punch head 21. The punch head 21 may be decelerated in preparation for reversing direction.

Figure 6:
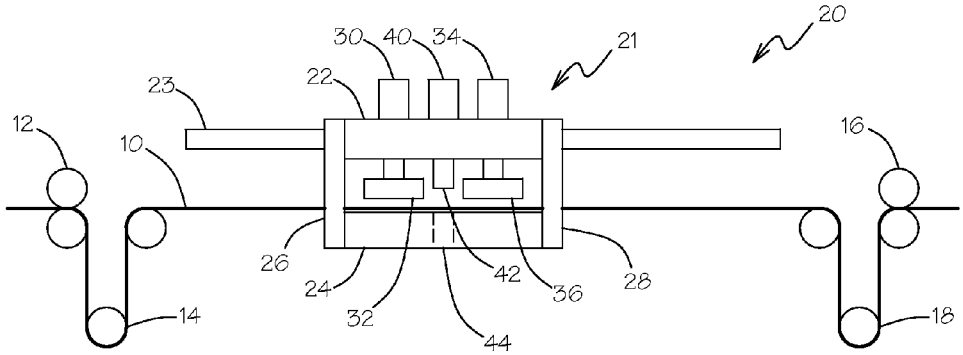

In FIG. 6 the punch head 21 is traveling in the direction opposite to the direction of travel of the web 10 to return the punch head to begin a new cycle. In FIG. 6 it may be seen that the left dancer 14 has descended and the right dancer 18 has risen to restore the slack taken up while the web 10 was gripped by the punch head 21.

Figure 7:
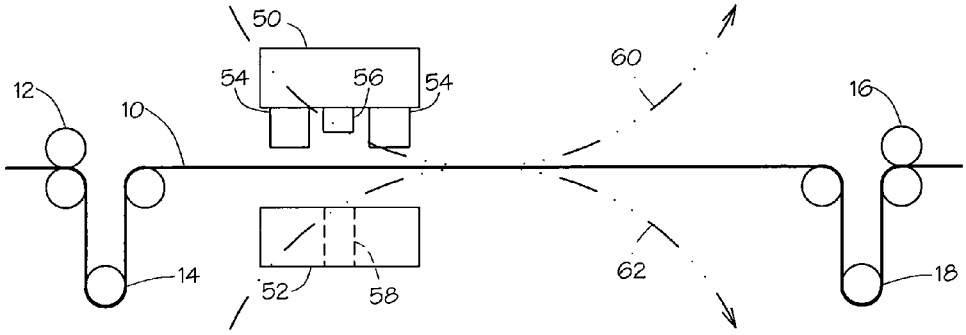
FIG. 7 is a schematic view of another punching station for a web that embodies the invention.

FIG. 7 shows another punching station for a web 10 that embodies the invention. The web transport system may be the same as shown for the previous embodiment.

A first toolbar 50 may include one or more clamps 54 and one or more punches 56. A second toolbar 52 may include corresponding punch blocks 58. The first and second toolbars 50, 52 are disposed on opposite sides of the web. The toolbars move along arcuate paths 60, 62 that bring the toolbars together while moving at substantially the same speed as the web 10. The arcuate paths 60, 62 may be circles of which only a portion is shown.

The clamp 54 may be resilient so that it will grip the web 10 as the toolbars 50, 52 are brought together by the arcuate paths 60, 62. The clamp may extend beyond the punch 56 so that the web 10 is firmly gripped before the punch is driven through the web and into the punch block 58 by the motion of the toolbars. The clamp may be any resilient clamping mechanism such as spring loaded grips or a resilient elastomer pad like sponge rubber. It will be appreciated that this embodiment uses the motion of the toolbars 50, 52 to actuate the clamp 54 and the punch 56.

FIGS. 7 through 11 illustrate a portion of an exemplary punching cycle. In FIG. 7 the toolbars 50, 52 are sufficiently separated that the web 10 is moving independently of the toolbars. The toolbars may be accelerating or decelerating to substantially the same speed as the web 10.

Figure 8:
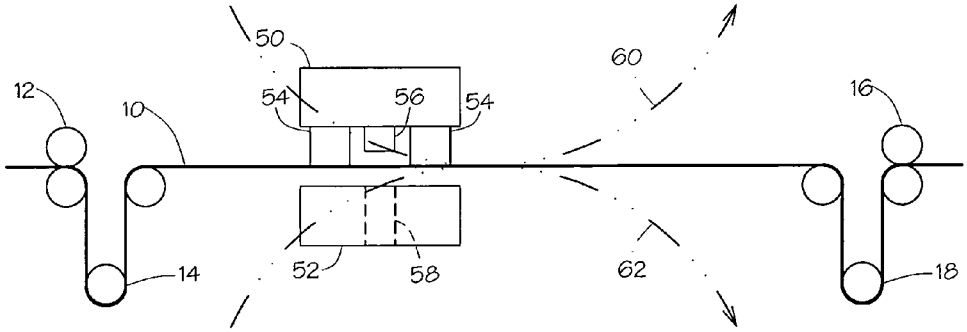
FIGS. 8 through 10 show the punching station of FIG. 7 at different point of the operating cycle.

FIG. 8 shows the clamp 54 coming into contact with the web 10. At this point the first toolbar 50 carrying the clamp 54 is separated from the second toolbar 52 on the opposite side of the web 10 and the web is not firmly gripped. The first toolbar 50 carrying the clamp 54 may be moving at substantially the same speed as the web 10 to minimize slippage between the web and the clamp.

Figure 9:
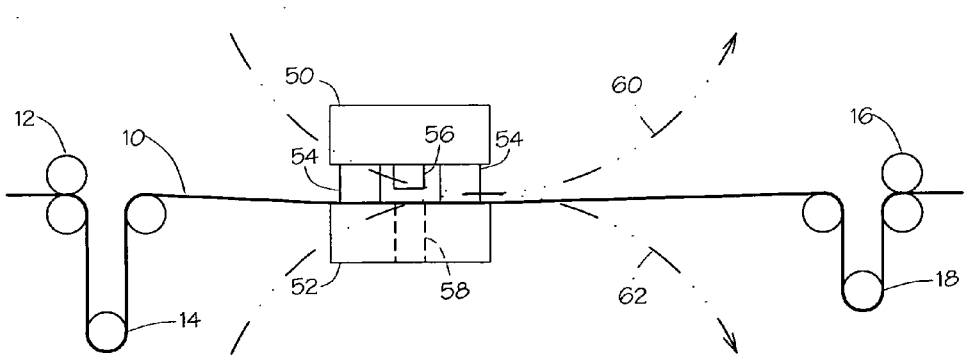

FIG. 9 shows the toolbars 50, 52 as the second toolbar 52 begins to compress the clamp 54 to firmly grip the web 10. In FIG. 9 it may be seen that the left dancer 14 has descended and the right dancer 18 has risen to accommodate tool bars that are moving slightly slower than the web 10. The dancers would move in the opposite manner to accommodate tool bars that are moving slightly faster than the web 10. If the toolbars 50, 52 were moving with a constant rotational velocity, the gripped portion of the web 10 might have a slightly varying linear velocity as the distance of the web from the center of the toolbar path varied during the punching cycle.

Figure 10:
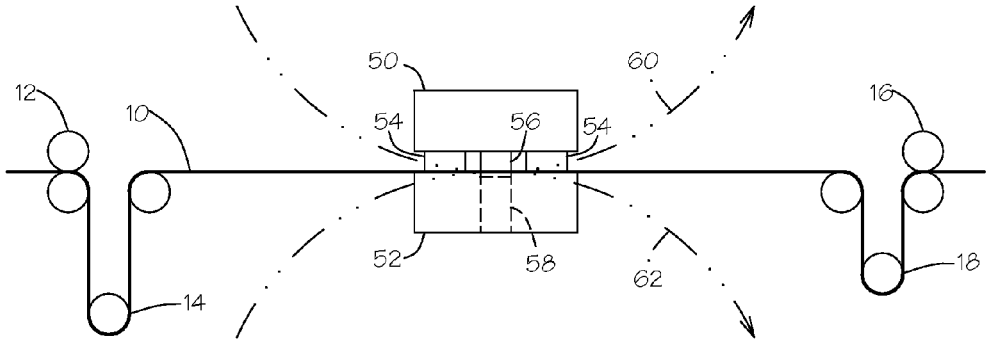

FIG. 10 shows the toolbars 50, 52 as the toolbars are in the closest proximity which drives the punch 56 through the web 10. It will be appreciated that the resilient clamp 54 will grip the web most securely at this point.

Figure 11:
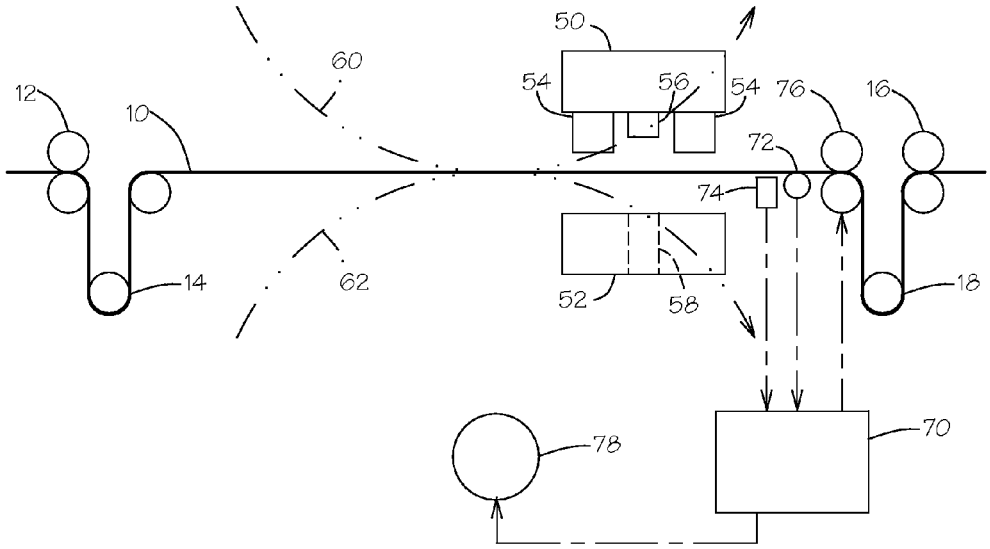
FIG. 11 shows the punching station of FIG. 7 at a different point of the operating cycle and with a control system.

As shown in FIG. 11 further motion of the toolbars 50, 52 along the arcuate paths 60, 62 will withdraw the punch 56 from the web 10 and then release the resilient clamp 54.

FIG. 11 shows a control system 70 that may be used with a punching station that embodies the invention. It will be appreciated that a similar control system could be used with other embodiments of the invention such as the embodiment shown in FIGS. 1 through 6.

The control system 70 may receive input from a velocity sensor 72 that gives the speed of the web 10. The motion of the punching station may be controlled by a motor 78. In the embodiment shown, the mechanisms for moving the two toolbars 50, 52 may be mechanically coupled and driven by a single motor 78. The web transport may include a pair of drive rollers 76 that control the speed of the portion of the web 10 adjacent the punching station. While the drive rollers are shown at the outlet of the punching station, it will be appreciated that the drive rollers may be positioned ahead of the punching station. In another embodiment, the speed of the portion of the web 10 adjacent the punching station may be controlled by controlling the motion of one of the dancers 14, 18.

The control system 70 may receive input from the velocity sensor 72 and use the velocity input to control any or all of the motion of the punching station and the portion of the web 10 adjacent the punching station. The control system 70 may operate to more closely match the speed of the punching station to the speed of the web 10 when the web is clamped in the punching station. The control system may cause the punching station to move at a significantly different speed than the web 10 when the web is not clamped in the punching station. This may allow punching to be spaced on the web at distances that are not equal to the circumference of a circular path for the toolbars in the embodiment shown in FIG. 11.

The control system 70 may receive input from a feature sensor 74 such as a photo detector that senses a periodic reference mark on the web. The control system may control any or all of the motion of the punching station and the portion of the web 10 adjacent the punching station to cause punching to occur at a predetermined location along the length of the web relative to the reference mark.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A method of punching a web which comprises:

advancing the web in a first direction at a first rate;

intermittently gripping a portion of the web;

advancing the portion in the first direction at a second rate that differs from the first rate;

moving a punch in the first direction at the second rate while gripping the portion; and punching the web with the moving punch while gripping the portion.

2. The method of claim 1 further comprising intermittently gripping a portion of the web with a resilient grip.

3. The method of claim 2 further comprising:

moving the resilient grip and the punch along a first arcuate path adjacent a first side of the web; and moving a toolbar located on a second side of the web opposite the first side along a second arcuate path adjacent the second side of the web such that the toolbar and the resilient grip approach one another to grip the web.

4. The method of claim 3 wherein the first arcuate path and the second arcuate path are each a complete circle.

5. The method of claim 1 further comprising detecting a reference mark on the web and moving the punch to cause the web to be punched at a predetermined location relative to the reference mark.

6. The method of claim 1 further comprising maintaining a loop of the web adjacent the portion that accommodates differences between the first rate and the second rate.

7. A punching station for a web which comprises:

a web transport system that operates to advance the web in a first direction at a first rate;

a clamp to intermittently grip a portion of the web and to advance the portion in the first direction at a second rate that differs from the first rate;

a punch coupled to the clamp such that the punch moves in the first direction together with the clamp;

a punch block that cooperates with the punch, the punch block coupled to the clamp such that the punch block moves in the first direction in unison with the clamp;

a punch actuator to cause the punch to penetrate the web and then to be withdrawn from the web while the web is gripped by the clamp.

8. The punching station of claim 1 wherein the clamp is a resilient grip, the resilient grip extending further toward the web than the punch, the resilient grip to prevent motion of the web in the first direction relative to the punch as the punch penetrates and is withdrawn from the web.

9. The punching station of claim 1 further comprising a sensor to detect a reference mark on the web and to cause the web to be punched at a predetermined location relative to the reference mark.

10. The punching station of claim 1 further comprising a first accumulator that discharges the web to the punch and maintains tension in the portion of the web between the first accumulator and the punch.

11. The punching station of claim 1 further comprising a second accumulator that receives the web from the punch and maintains tension in the portion of the web between the punch and the second accumulator.

12. The punching station of claim 1 further comprising:

a first toolbar coupled to the clamp and the punch and located on a first side of the web; and a second toolbar coupled to the punch block and located on a second side of the web opposite the first side;

wherein the punch actuator causes each of the first toolbar and the second toolbar to move along respective arcuate paths when the first toolbar and the second toolbar are adjacent the web.

13. The punching station of claim 12 wherein the punch actuator causes each of the first toolbar and the second toolbar to move in a complete circle.

14. A punching station for a web which comprises:

means for advancing the web in a first direction at a first rate;

means for intermittently gripping a portion of the web;

means for advancing the portion in the first direction at a second rate that differs from the first rate;

means for moving a punch in the first direction at the second rate while gripping the portion; and means for punching the web with the moving punch while gripping the portion.

15. The punching station of claim 14 wherein means for intermittently gripping a portion of the web is a resilient grip.

16. The punching station of claim 15 further comprising:

means for moving the resilient grip and the punch along a first arcuate path adjacent a first side of the web; and means for moving a toolbar located on a second side of the web opposite the first side along a second arcuate path adjacent the second side of the web such that the toolbar and the resilient grip approach one another to grip the web.

17. The punching station of claim 16 wherein the first arcuate path and the second arcuate path are each a complete circle.

18. The punching station of claim 14 further comprising means for detecting a reference mark on the web and means for moving the punch to cause the web to be punched at a predetermined location relative to the reference mark.

19. The punching station of claim 14 further comprising means for maintaining a loop of the web adjacent the portion that accommodates differences between the first rate and the second rate.

* * * * *